United States Patent [19]

Rovin

[11] 4,289,085

[45] Sep. 15, 1981

[54] BOBBIN LOADING APPARATUS FOR SEWING MACHINES

[76] Inventor: Herman Rovin, Rte. 3, Box 370A, Piedmont, S.C. 29673

[21] Appl. No.: 76,938

[22] Filed: Sep. 19, 1979

[51] Int. Cl.[3] ..... D05B 45/00; D05B 65/00

[52] U.S. Cl. ..... 112/181; 112/279; 226/113; 242/129.1

[58] Field of Search ..... 112/181, 186, 285, 279; 226/159, 158, 113; 242/20, 18 R, 18 AA, 129.1

[56] References Cited

U.S. PATENT DOCUMENTS 3,509,840 5/1970 Rovin ..... 112/181

4,117,789 10/1978 Rovin et al. ..... 112/181

4,244,313 1/1981 Rovin et al. ..... 112/181

*Primary Examiner*—Werner H. Schroeder

*Assistant Examiner*—Andrew M. Falik

*Attorney, Agent, or Firm*—Mandeville and Schweitzer

[57] ABSTRACT

A device for automatically supplying thread to the bobbin of a sewing machine of the kind wherein there is a thread feed tube arranged to receive the thread from a bulk source, a predetermined length of the thread is delivered to a rapidly rotating bobbin for winding of the thread thereon and then the thread is severed from the source.

15 Claims, 14 Drawing Figures

BOBBIN LOADING APPARATUS FOR SEWING MACHINES

BACKGROUND OF THE INVENTION

In my U.S. Pat. No. 3,509,840, and pending application Ser. No. 896,884, Apr. 17, 1978, U.S. Pat. No. 4,244,313 there are shown devices for automatically supplying thread to the bobbin of a sewing machine wherein the thread is drawn from a bulk source by a thread feed tube and delivered thereby to the bobbin for winding of a predetermined length of thread upon the bobbin. This invention is designed to accomplish the same operation by means of different mechanisms comprised of a lesser number of component parts, thus reducing the initial cost, reducing maintenance costs, simplifying adjustment for a particular operation and especially designed to supply thread to a sewing machine wherein the bobbin is disposed to rotate about a vertical axis.

SUMMARY OF THE INVENTION

As herein illustrated, the thread loading device is designed to deliver thread from a bulk source to the rapidly rotating bobbin of a sewing machine of the kind wherein the bobbin is disposed to rotate about a vertical axis and comprises a carriage supported for linear reciprocal movement relative to the bobbin, means for effecting reciprocal movement of the carriage, a thread carrier mounted on the carriage for movement with and relative to the carrier, means for withholding the forward movement of the thread carrier during a portion of the forward movement of the carriage, means for disabling the last-named means at a predetermined forward position of the carriage and means for propelling the thread carrier forwardly relative to the carriage to advance the thread carrier to loading position. The means for withholding forward movement of the carrier during forward movement of the carriage is a latch engaged with a recess in the carrier and the means for disabling the latch is a dog on the carriage movable forwardly therewith into engagement with the latch at the predetermined forward position of the carriage. The means for propelling the thread carrier forwardly when released is spring means stressed in tension during relative movement of the carriage and carrier. The thread carrier embodies a thread carrying tube which receives at one end a thread from a bulk source of thread and discharges thread from the other end at the loading position into an opening in the bobbin case. There is a thread clamp on the carrier which clamps the thread thereto during the forward movement of the carrier so as to draw thread from the bulk source and means comprising a cam for disabling the thread clamp by retracting it from engagement with the thread to allow the thread to be moved forwardly within the thread tube and there is means for supplying a jet of air to the thread tube to propel the thread when released forwardly through the tube. There is a thread measuring device situated between the bulk source and the thread tube for measuring the length of thread drawn off by the rotating bobbin and switch means operable when a predetermined length has been withdrawn to energize a solenoid operated brake on the thread to stop rotation of the bobbin and initiate retraction of the carriage and thread carrier. During the initial moments of retraction, the thread clamp is allowed to reclamp the thread so that some thread is withdrawn from the bobbin and to place the thread between the bobbin and the thread tube in tension for cutting. There are concentrically-arranged, relatively rotatable thread cutters for cutting the tensioned thread between the bobbin and the thread feed tube and means operable during the forward movement of the carriage to align the cutters in a position to permit the thread to be drawn through the cutters to the loading position and means operable during retraction of the carriage and thread carrier to effect operation of the thread cutters to cut the thread.

The invention will now be described in greater detail with references to the accompanying drawings, wherein.

Figure 1:
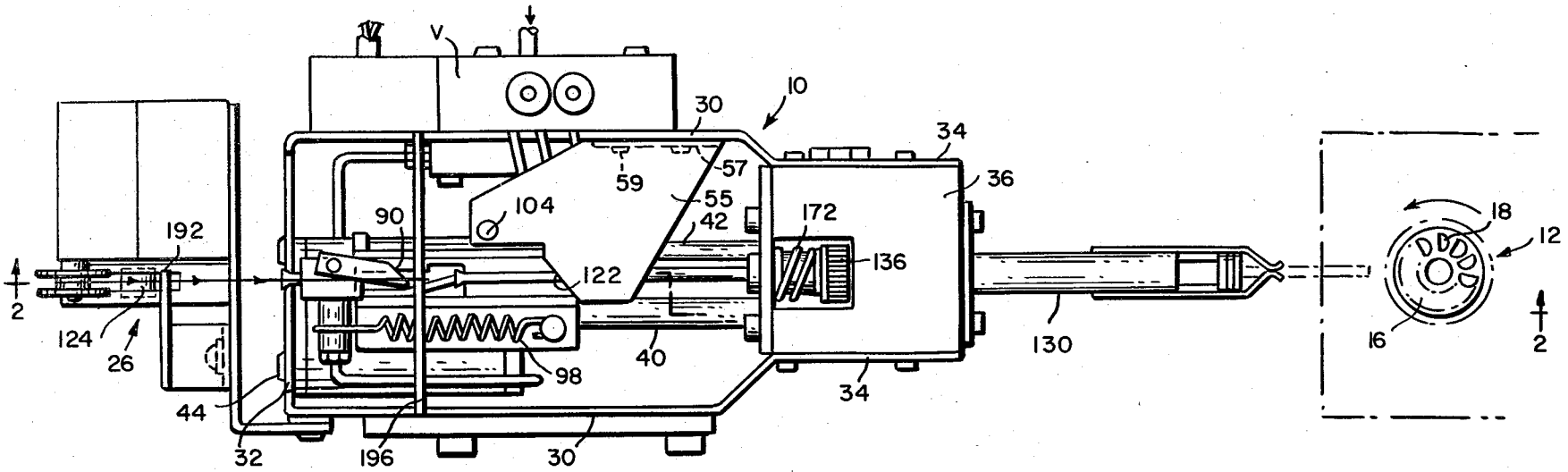
FIG. 1 is a plan view of the device shown in relation to the bobbin and bobbin supporting casing of a sewing machine wherein the bobbin is rotatable about a vertical axis and wherein the thread feed tube is in its retracted position.

Referring to the drawings, FIGS. 1 and 2, the thread loading device 10 of this invention is supported by suitable means in a horizontal position at the level of the bobbin and bobbin case 12 of the sewing machine with which it is to be used wherein the bobbin is rotatable about a vertical axis and the thread loading instrumentality as will be described hereinafter is designed to enter an opening 14 in the casing 12 for winding on a bobbin 16 therein, the latter being propelled in rotation by projection of a stream of air against its pocketed upper end surface 18 as disclosed, for example, in my U.S. Pat. No. 3,509,840 and pending application for patent Ser. No. 896,884, filed Apr. 17, 1978.

Figure 2:
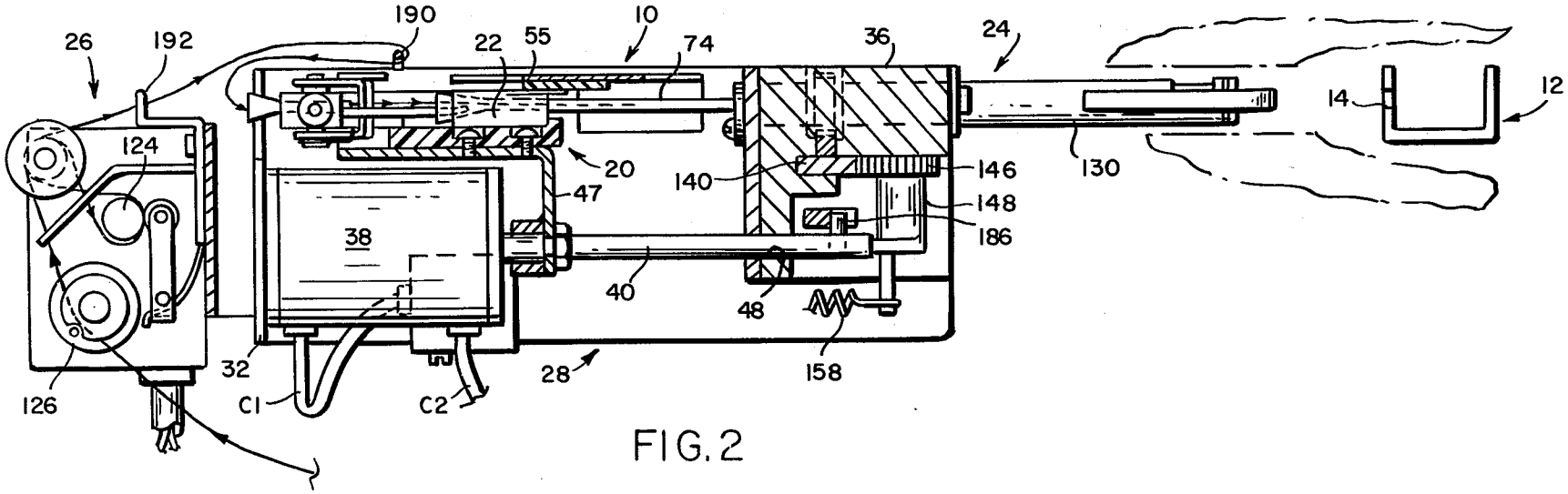
FIG. 2 is an elevation of FIG. 1 taken on the line 2—2 of FIG. 1 with parts shown in section.
Figure 3:
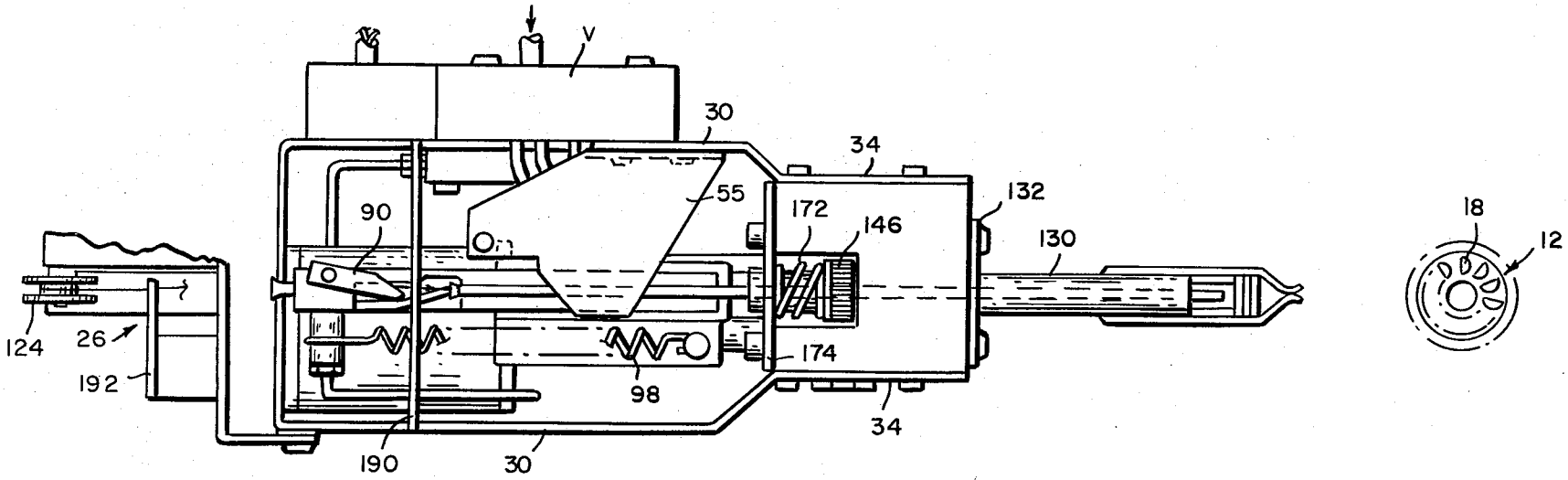
FIG. 3 is a plan view like FIG. 1 showing the carriage supporting the thread carrier in its forward position just before the thread carrier is projected to its loading position.
Figure 4:
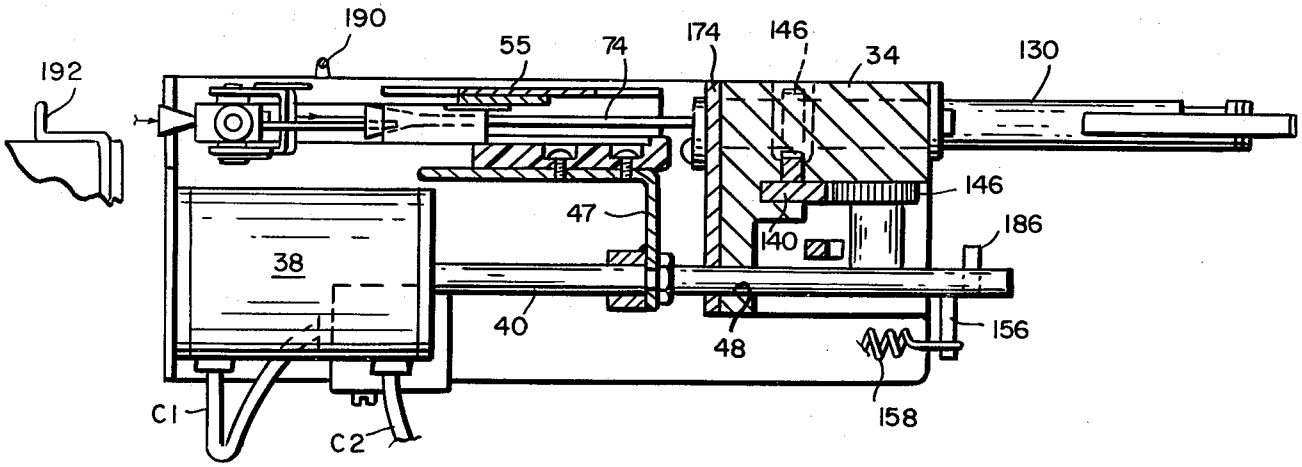
FIG. 4 is an elevation of FIG. 3.
Figure 5:
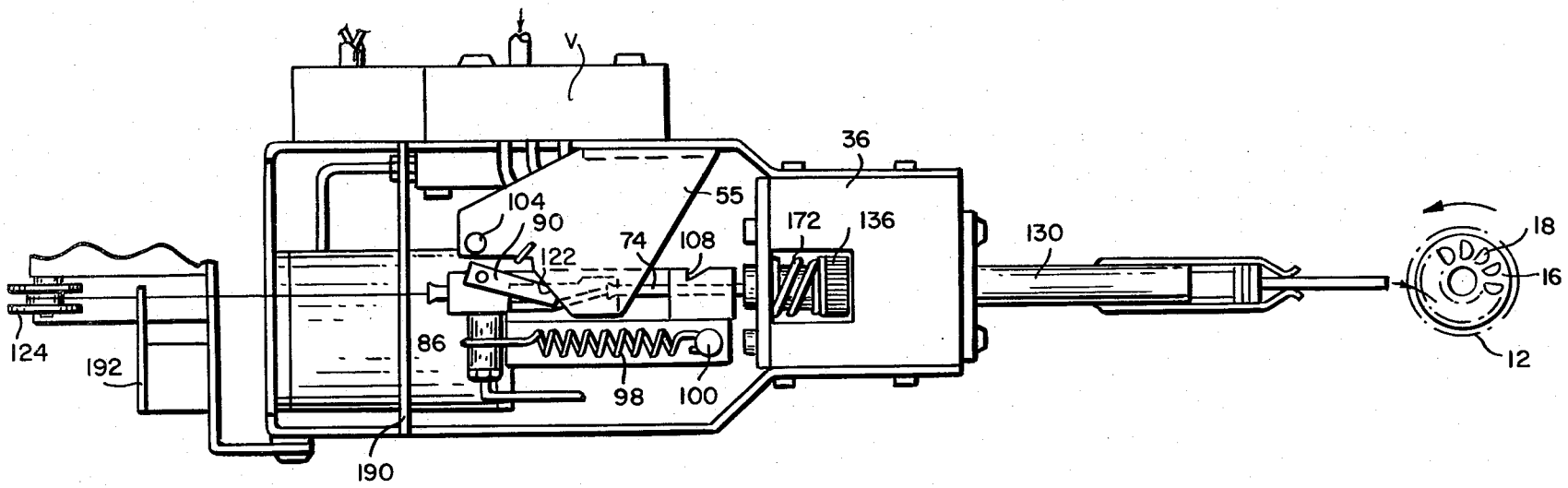
FIG. 5 is a plan view corresponding to FIGS. 1 and 3 showing the thread carrier projected to its loading position.
Figure 6:
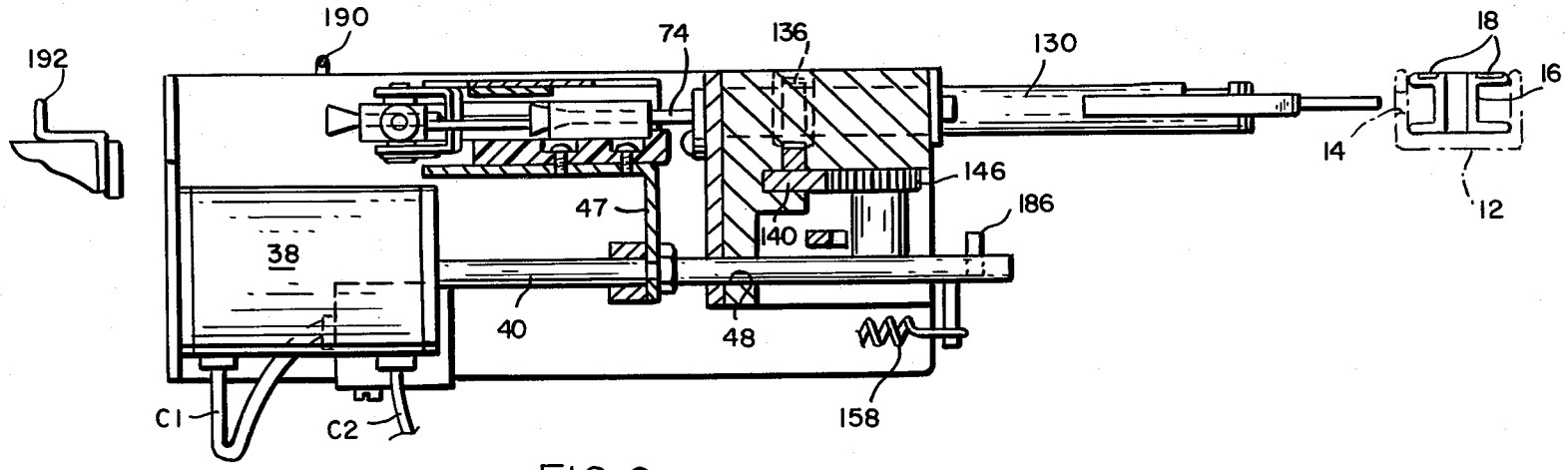
FIG. 6 is an elevation of FIG. 5 with parts shown in section.

The thread loading device 10 comprises essentially a reciprocally mounted carriage 20, FIG. 2, a thread carrier 22, thread cutting mechanism 24, means 26 for supplying thread to the thread carrier, and a supporting frame 28.

The frame 28, FIG. 1, has transversely-spaced side walls 30—30, a transverse rear wall 32 and at the other end spaced, parallel extensions 34—34 between which there is mounted a block 36.

A double-acting air cylinder 38 from one end of which projects a piston rod 40 and a guide rod 42 is mounted in the frame with its rear end fastened by means of bolts 44—44 to the rear wall 32 and with the piston rod 40 and guide rod 42 extending forwardly into openings 48 and 50 in the block 36.

Figure 8:
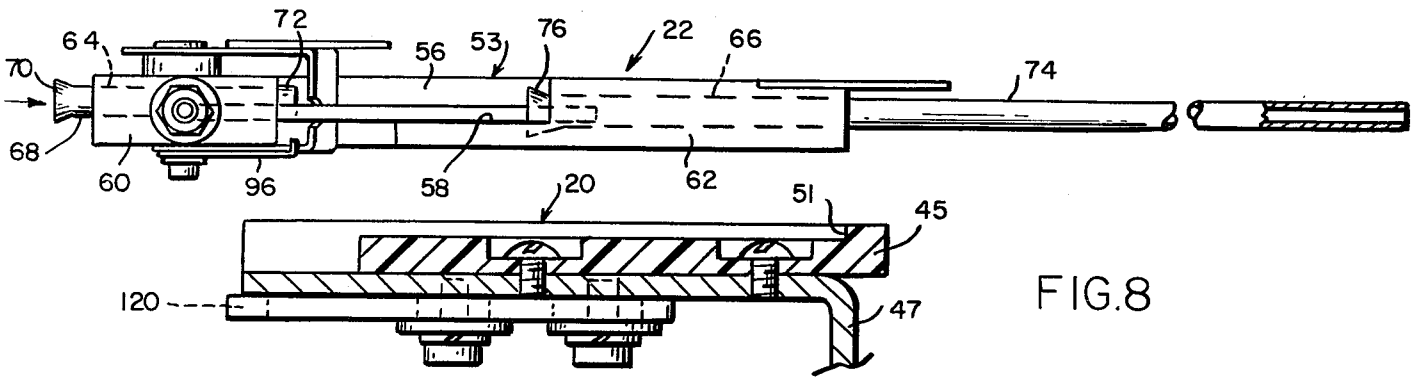
FIG. 8 is an exploded elevation partly in section of the carriage and thread carrier.

The carriage 20, as shown more clearly in the exploded view of FIG. 8, comprises a part 45 fastened by an angle bracket 47 to the piston rod 40 and to prevent tilting of the angle bracket, the latter is provided with a recess 49 slidably engaged with the guide rod 42. Reciprocal movement of the piston rod 40 will accordingly move the carriage 20 forwardly and rearwardly in a horizontal plane.

The upper surface of the part 45 of the carriage supports the thread carrier 22 which slidingly fits into a recess 51 in the top of the part 45.

The thread carrier 22 comprises a long, narrow block 53 corresponding in width to the width of the recess 51 which rests within the recess and is slidingly held therein by an overlying plate 55, the underside of which has engagement with the top side of the block 53. The plate 55 is provided with a right angularly disposed flange 57 for receiving fastening bolts 59 which fix the plate 55 to the frame. The block 53 contains at one side a recess 56 which extends downwardly therein so that its bottom 58 is just below the mid-plane level and contains at its ends in the portions 60 and 62 rearwardly and forwardly of the recess 56 axially disposed passages 64 and 66. A portion of a thread tube 68 provided with a flared end 70 is fixed in the passage 64 with the flared end extending rearwardly and the other end extending forwardly into the recess 56. A second portion 74 of the thread tube is fixed in alignment with the thread tube 68 with a flared end 70 extending into the recess 56 and its other end extending forwardly from the block 60. The portion of the block 60 rearwardly of the recess 56 contains a transverse opening 76 extending partway into it and a right angularly disposed longitudinal opening 78 connected at one end to the transverse opening and at its other end into the recess 56. An air tube 80 is mounted in the recess with one end 82 fixed in the longitudinal opening 78 and its other end 84 fixed within the flared end of the thread tube 74. A coupling element 86 is secured to the portion 60 over the transverse opening 76 and has coupled thereto a flexible air hose 88 by means of which air is supplied through the air tube 80 to the thread tube 74. A latch arm 90 is pivotally mounted at one end on a pin 92 to the top of the block 53 which has at its distal end a clamping element 94 which extends down into the recess parallel to the side of the recess and this clamp element 94 is yieldably held against the side of the recess by a spring 96.

The thread carrier as thus mounted is movable forwardly and rearwardly in reciprocation with the carriage and is movable relative thereto. A coiled spring 98 is connected at one end to the coupling 86 of the thread carrier and at its opposite end by means of a pin 100 to the carriage so that the forward end of the thread carrier is yieldably held against the forward end of the recess 51. At this position of the thread carrier on the carriage, a latch 102 pivotally mounted by means of a pin 104 to the underside of the plate 55 by engagement of a tooth 106 at its distal end with a notch 108 in the side of the block 53 opposes forward movement of the thread carrier. A spring finger 110 normally holds the latch engaged.

Figures 9, 10, 11, 12, 13, 14:
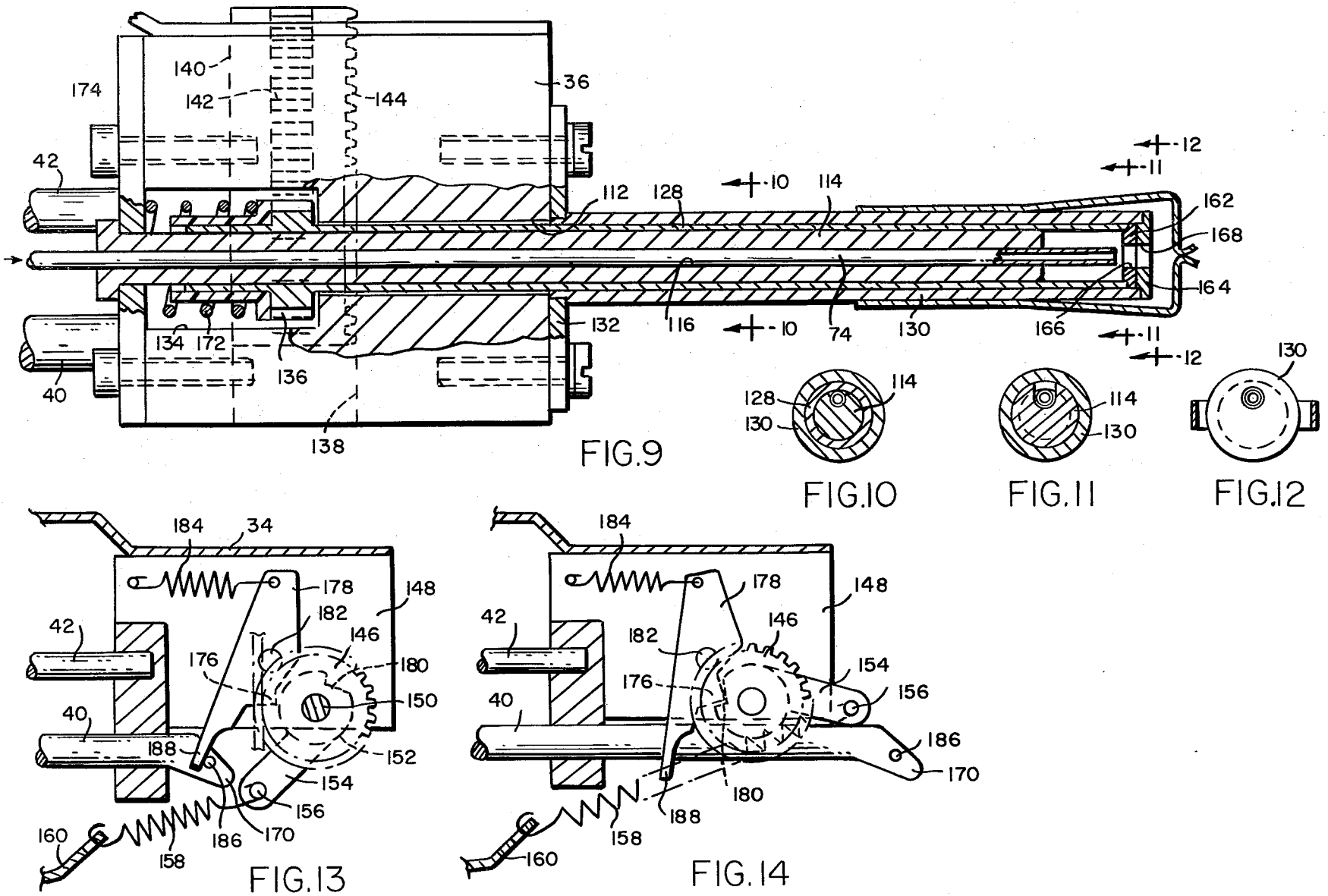
FIG. 9 is a plan view of the thread cutter and its operating mechanism with parts in section.
FIG. 10 is a section taken on the line 10—10 of FIG. 9.
FIG. 11 is a section taken on the line 11—11 of FIG. 9.
FIG. 12 is a section taken on the line 12—12 of FIG. 9.
FIG. 13 is a fragmentary view of the latch mechanism prior to movement into operative position.
FIG. 14 is a similar view showing the latch in its operative position.

The block 36, as previously stated, contains holes 48 and 50 through which a piston rod and guide rod slidably extend and, in addition, it contains a passage 112, FIG. 9, within which there is fixed a guide tube 114 containing an axial bore 116 for slidingly receiving the thread tube 74.

Figure 7:
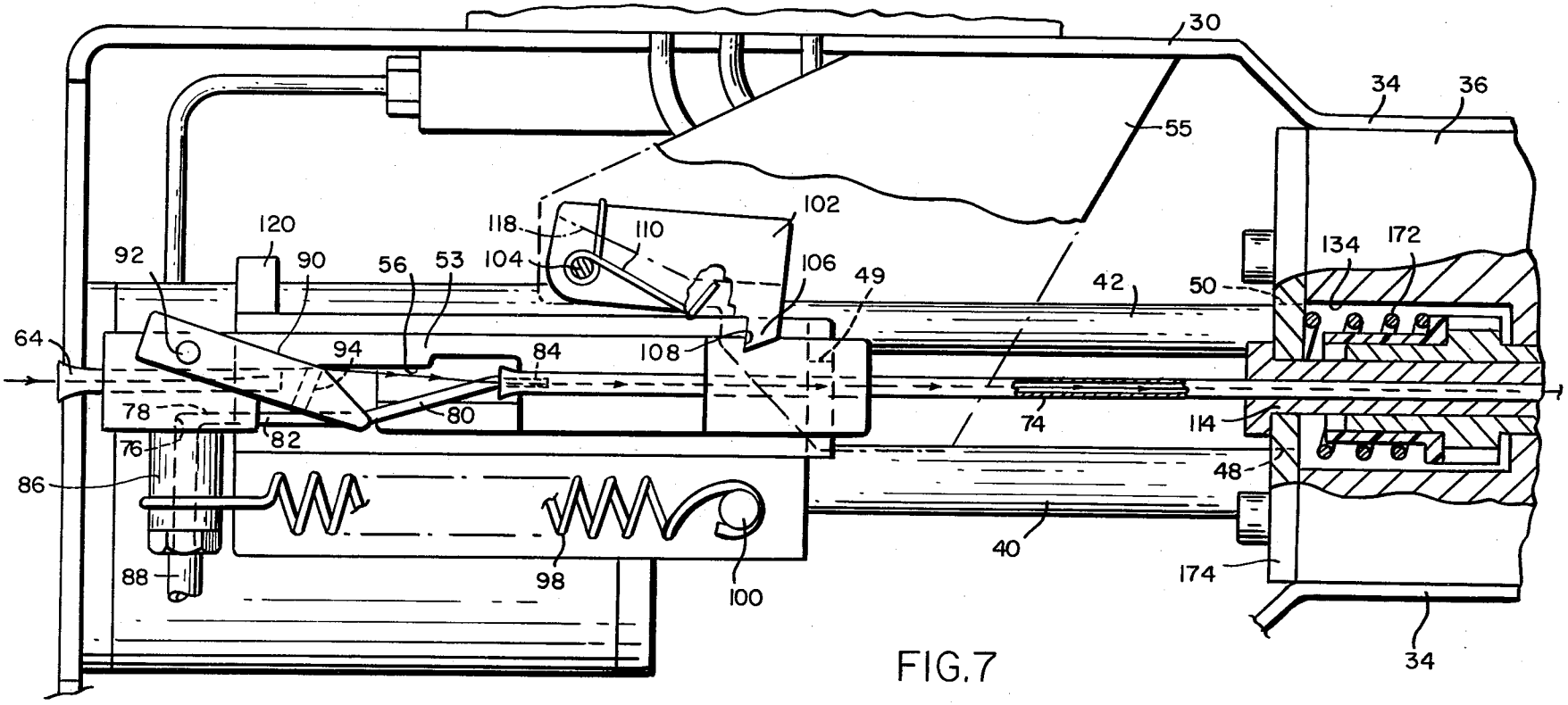
FIG. 7 is a plan view to much larger scale with the thread clamp cam broken away in part and a portion of the thread carrying tube sectioned.

In operation, as thus far described, forward movement of the piston rod 40 effected by supplying air pressure through the conductor C1 to the rear end of the air cylinder 38 will advance the carriage forwardly toward the block 36. The latch 102 prevents corresponding forward movement of the thread carrier and as the carriage moves forwardly, the spring 98 is stretched in tension. The latch 102 has at its lower side an inclined cam surface 118 and the block 53 has at its rear end a dog 120 which when moved forwardly into engagement with the inclined surface 118 will disengage the tooth 106 from the notch 108 to allow, when the carriage has moved to its forward position, the thread carrier to be projected forwardly at a rapid rate by the tensioned spring 98 into a position such that the forward end of the thread tube is adjacent the hole 14 in the bobbin case. The forward movement of the thread carrier and thread carrying tube is designed to present a free length of thread to the bobbin and to this end the thread is led from a suitable source as will be described hereinafter through the tube portion 64, the recess 56 and the tube portion 74 to a position such that its forward end extends from the forward end of the feed tube. The thread is held clamped in this position during the forward movement of the carriage and the thread carrier by the clamp arm 90, the clamp element 94 of which pinches the thread against the side of the recess, as shown in FIG. 7. When the thread carrier is projected forwardly, the distal end of the arm is deflected away from the wall of the recess so as to release the thread by an inclined cam surface 122, FIG. 1 on the plate 55. At the same time that air pressure was supplied to the rear end of the cylinder 38 to move the carriage forwardly, air is supplied through the conductor 88 to the air tube 80 so as to inject a stream of air into the thread tube and this air, when the thread is unclamped, projects the thread forwardly in the tube and into the hole in the bobbin case so that the end is entrained by the rotating bobbin and commences to be wound onto the bobbin.

When a predetermined length of thread is wound onto the bobbin as measured by a measuring element 124, FIGS. 1 and 2, on the thread supplying device 26, a brake 126 is applied to stop the thread and simultaneously initiate retraction of the carriage and thread carrier by supplying pressure through the conductor C2 to the opposite end of the air cylinder 38. As the carriage and carrier are retracted, the thread clamp 90 is disengaged from the cam element 122 so that the thread is reclamped to the thread carrier and some of the thread is withdrawn from the bobbin leaving, however, a length of thread between the bobbin and the retracted forward end of the thread tube intact and in tension for cutting off.

The thread cutting means 24 comprises a concentrically-arranged, relatively rotatable tube 128. The tube 128 is rotatably mounted within the hole 112 in the block 36 in concentric relation with the thread guide tube 114 and the tube 130 is fixed to the forward end of the block 36 by means of a face plate 132. At the rear end of the block 36, there is an enlarged opening 134 concentric with the hole 112 into which the rear end of the sleeve 128 extends and the latter has formed on it a pinion gear 136. The block 36 contains a transverse opening 138 within which there is slidingly mounted a compound rack bar 140 having at one side rack teeth 142 which mesh with the pinion gear 136 and at another side teeth 144 which mesh with a gear 146, FIG. 13. The gear 146 is rotatably mounted in an opening 148 for rotation about a pin 150. The gear 146 has fixed to it a hub 152 provided with an arm 154 having at its distal end a pin 156. One end of a spring 158 is connected to the pin 156 and the other end of the spring is fixed to a stationary part 160 of the frame, thus the gear is urged to rotate in a clockwise direction as viewed in FIGS. 13 and 14. Rotation of the gear 146 by engagement with the compound rack effects linear movement of the rack which, in turn, effects rotation of the rotatable tube 128 relative to the fixed tube 130. At the ends of the tubes 128 and 130 are, respectively, flat cutting plates 162 and 164 containing, respectively, openings 166 and 168. In the aligned positions of the holes 166 and 168 the thread tube is free to pass through to its loading position and, in doing so, draws the thread through these openings. At the returned position of the thread tube, the tensioned length of thread from the bobbin extends through the openings and into the retracted end of the thread tube so that by rotation of the rotatable tube relative to the fixed tube, the cutting plate 166 operates in shearing relation to the plate 164 to cut the thread off.

The thread tubes are rotated relative to each other to align the openings 166 and 168 during forward movement of the carriage by an actuator 170 at the forward end of the piston rod 40 with which the distal end of the arm 154 is aligned so that such forward movement turns the gear 146 in a counterclockwise direction and such counterclockwise direction moves the compound rack 140 in a direction to rotate the rotatable tube relative to the fixed tube to align the openings. A coiled spring 172 is mounted about the rear end of the rotatable tube 128 within the opening 134 with one end fixed to the block 34 by way of a cover plate 174 bolted to the rear side and at its other end to the rotatable sleeve so that during rotation of the sleeve 128 to position the holes in alignment, the spring 132 is wound up in tension. The rotatable sleeve is held in opposition to the uncoiling force of the spring 172 at the aligned position by engagement of a dog 176 on a latch 178 with a recess 180 in the hub 152 of the gear. The latch 178 is pivotally supported on a pin 182 and is yieldably held in its engaged position by a coiled spring 184, one end of which is connected to one end of the latch 178 and the other end of which is fixed to the block 34. As thus constructed, after the thread has been wound onto the bobbin and a measured length thereof has been detected and initiated retraction of the carriage and thread carrier, rearward movement of the carriage and the piston rod 40 engages a pin 186 with a finger 188 on the latch 178 so as to disengage the dog 176 from the notch 180, thus releasing the gear and allowing the spring 172 to rapidly rotate the rotatable tube to cut off the thread.

The thread supply 26 is similar to that shown in the aforesaid patent and pending application and, as previously related, embodies a measuring wheel 124, a brake 126 and, in addition, suitable guides for guiding the thread from a bulk source over the brake and measuring device to the entrance to the thread tube. In addition, there is a slack-producing bar 190 which operates in conjunction with a guide 192 to provide a slack length of thread in readiness for propulsion through the thread tube when the thread clamp is disengaged from the thread.

Air is supplied at appropriate times to the air cylinder 38 and to the feed tube 74 by valve means V attached to the side of the frame 28.

In operation, the thread measuring wheel 124 is set to measure out a predetermined length of thread which may be for a single sewing operation or several sewing operations, whereupon a cycle of operation is initiated by supplying air through the valve V to the rear end of the cylinder 38 and to the air tube 80. Supplying air to the rear end of the cylinder 38 moves the carriage forwardly while the thread carrier remains in its initial position with the thread clamped to it. During this forward movement, the spring 98 is stretched so as to cock the thread carrier. Also during this forward movement the piston rod by rotating the gear 146 effects rotation of the rotatable tube within the fixed tube to align the openings in the cutting plates 162 and 164. At the forward movement of the carriage, the dog 120 displaces the latch 102, allowing the thread carrier to fly forwardly very rapidly and to project the thread tube through the thread guide and through the aligned openings in the cutting plates to a position of loading. Simultaneously, the latch 178 is engaged with the gear 146 to hold the tubes with their plates in alignment in opposition to the spring 172. Also during this time air is projected through the thread tube so as to carry the thread from the delivery end of the thread tube into the bobbin casing. When the predetermined length of thread is delivered, a switch is actuated which reverses the flow of air to the cylinder 38 so as to retract the latter. During the initial retractive movement, the thread clamp is released so that it again clamps the thread to the thread carrier, thus drawing some of the thread from the bobbin and placing the thread in tension between the bobbin and the end of the thread tube at the retracted position of the thread tube. At the moment when the carriage and thread carrier reach their retracted position, the pin 186 at the forward end of the piston rod disengages the latch 178, releasing the gear 146 so that the spring 172 rotates the rotatable tube 128 relative to the fixed tube and thus shears the thread, completing the cycle.

As has already been disclosed in the pending application, the rearward movement of the carriage pulls off a slack length of thread from the bulk source and, to this end, the thread brake is partially released so as to enable the thread to be pulled off.

It should be understood that the present disclosure is for the purpose of illustration only and includes all modifications or improvements which fall within the scope of the appended claims.

I claim:

1. Apparatus for presenting thread to a rapidly rotating bobbin comprising a carriage supported for linear reciprocal movement relative to the bobbin, means for effecting reciprocal movement of the carriage, and a thread carrier mounted on the carriage, for movement with and relative to the carriage, means for withholding forward movement of the thread carrier during a portion of the forward movement of the carriage, means for disabling the last-named means at a predetermined forward position of the carriage, and means for propelling the thread carrier forwardly relative to the carriage to advance the thread carrier to thread loading position.

2. Apparatus according to claim 1 wherein means for withholding the thread carrier is a latch, and the means for propelling the thread carrier forwardly relative to the carriage to advance the thread carrier to the loading position is spring means stretched in tension by the movement of the carriage relative to the thread carrier.

3. Apparatus according to claim 1 comprising a clamp on the thread carrier yieldably held in clamping engagement with the thread on the thread carrier at the retracted position of the latter and cam means operable at the forward position of the thread carrier to release the thread so that it can be drawn forwardly on the carriage.

4. Apparatus according to claim 3 wherein said thread clamp is released into clamping engagement with the thread on the carrier at the beginning of retraction of the carrier.

5. Apparatus according to claim 1 wherein a thread tube is mounted on the thread carrier through which the thread extends, said thread tube containing a breach through which the thread clamp extends for clamping the thread and an air tube is connected to the thread tube for supplying air under pressure to the thread tube to propel the thread from the thread tube when the thread clamp is retracted.

6. Apparatus according to claim 1 wherein the means for effecting reciprocation of the carriage is a double-acting air cylinder provided with spaced, parallel piston rods, means connecting the carriage to one of the piston rods and fixed guide means slidingly receiving the piston rods.

7. Apparatus according to claim 1 comprising a thread cutter supported in the path of travel of the thread carrier movable from an inoperative cocked position while the thread carrier is in loading position to an operative position when the thread carrier is retracted, means operable by forward movement of the carriage to move the thread cutter to said inoperable cocked position and means operable as the carriage returns to its retracted position to cause the cutter to cut the thread.

8. Apparatus according to claim 7 wherein a spring is stressed by movement of the carrier to its loading position to cock the cutter, a latch is actuated to hold the cutter cocked and there is means operable by retraction of the carriage to disable the latch.

9. Apparatus according to claim 1 comprising a fixed cutter component supported in alignment with the thread tube containing an opening through which the thread tube is slidable in reciprocation, a movable cutter component containing an opening which is moved into alignment with the opening in the fixed cutter component during the forward movement of the carriage and projection of the thread tube into loading loading position to permit the thread tube to pass through the aligned openings and means for rotating the movable cutter relative to the fixed cutter to shear the thread when the thread tube is withdrawn by retraction of the carriage.

10. Apparatus according to claim 1 comprising a fixed cutter component supported in alignment with the thread tube containing an opening through which the feed tube is slidable, a movable cutter mounted to turn in shearing relation to the fixed cutter containing a hole movable into alignment with the hole in the fixed cutter to permit the thread to be drawn through with the thread tube as the latter is moved to loading position, a spring connected to the rotatable cutter component, means for winding the spring in torsion as the thread tube is moved to loading position, means for holding the rotatable cutter cocked during retraction of the thread tube and means for releasing the last-named means at the retracted position of the carriage.

11. Apparatus according to claim 10 wherein the means for cocking the cutter comprises first and second gears, means operable by forward movement of the carriage to rotate the first gear, rack means engaged with the first and second gears operable by rotation of the first gear to effect rotation of the second gear and means operable by rotation of the second gear to wind the spring in torsion.

12. Apparatus according to claim 11 wherein a latch spring loaded at the cocked position of the cutter into engagement with the first gear locks the first gear and, hence, the rack means in cocking position, and means operable by retraction of the carriage to disable the latch.

13. Apparatus according to claim 1 comprising concentrically mounted tubes, one of which is rotatable and the other of which is fixed through which the thread tube is reciprocated relative to the bobbin, cutter plates fixed to the ends of the tubes defining aligned cutting edges through which the thread is drawn by the thread tube and left when the thread tube is retracted and means for rotating the rotatable tube relative to the fixed tube to move the cutting edges in shearing relation to cut the thread.

14. Apparatus according to claim 1 comprising a fixed guide tube containing an axial groove within which the thread tube is reciprocal relative to the bobbin, a first cutter sleeve rotatably mounted on the guide tube, a second cutter sleeve concentric with the first cutter sleeve fixed relative to the first cutter sleeve, cutter plates fixed to the ends of the sleeves face-to-face containing openings defining cutting edges movable in shearing relation by rotation of the rotatable tube relative to the fixed tube and means for effecting rotation of the rotatable tube as the carriage returns to its retracted position.

15. Apparatus for presenting thread to a rapidly rotating bobbin comprising a carriage containing a track component, a thread carrier having a track component mounted on the carriage with its track component slidingly engaged with the track component on the carriage, a latch fixed relative to the movement of the carriage yieldably held engaged with the thread carrier, said latch withholding forward movement of the thread carrier during forward movement of the carriage, latch release means on the carriage movable into engagement with the latch at a predetermined forward position of the carriage to release the thread carrier and spring means connected at one end to the thread carrier and at its other end to the carriage extended by relative movement of the carriage and carrier and operable when the thread carrier is released to project the thread carrier forwardly to loading position.

* * * * *